US009624011B2

(12) United States Patent
Strachan et al.

(10) Patent No.: US 9,624,011 B2
(45) Date of Patent: Apr. 18, 2017

(54) LID WITH ROTATABLE CLOSURE TAB

(71) Applicant: uVu Technologies, LLC, Boca Raton, FL (US)

(72) Inventors: Mark Strachan, Jupiter, FL (US); David Weiss, Boca Raton, FL (US)

(73) Assignee: UVU TECHNOLOGIES, LLC, Boca Raton, FL (US)

( * ) Notice: Subject to any disclaimer, the term of this patent is extended or adjusted under 35 U.S.C. 154(b) by 0 days.

(21) Appl. No.: 14/554,592

(22) Filed: Nov. 26, 2014

(65) Prior Publication Data

US 2015/0251818 A1 Sep. 10, 2015

Related U.S. Application Data

(60) Provisional application No. 61/948,268, filed on Mar. 5, 2014.

(51) Int. Cl.

| | |
|---|---|
| ***A47G 19/22*** | (2006.01) |
| ***B65D 47/26*** | (2006.01) |
| ***B65D 43/02*** | (2006.01) |

(52) U.S. Cl.

CPC ..... *B65D 47/265* (2013.01); *A47G 19/2272* (2013.01); *B65D 43/0208* (2013.01);

(Continued)

(58) Field of Classification Search

CPC ..... B65D 47/265; B65D 43/0208; B65D 2543/00555; B65D 2543/00805;

(Continued)

(56) References Cited

U.S. PATENT DOCUMENTS

| | | | |
|---|---|---|---|
| 3,620,437 | A | 11/1971 | Kulp |
| 4,241,864 | A | 12/1980 | Kessler |

(Continued)

FOREIGN PATENT DOCUMENTS

| | | | |
|---|---|---|---|
| JP | 2004520239 | A | 7/2004 |
| JP | 2008531412 | A | 8/2008 |

(Continued)

OTHER PUBLICATIONS

Definition of "circular". Merriam-Webster Dictionary Online. http://www.merriam-webster.com/dictionary/circular Jan. 8, 2016.*

(Continued)

*Primary Examiner* — James N Smalley

(74) *Attorney, Agent, or Firm* — Amster, Rothstein & Ebenstein LLP

(57) ABSTRACT

A lid includes: a brim sealing channel at a periphery of the lid; an outer sipping sidewall positioned within a circumference of the brim sealing channel and extending above the brim sealing channel; a sipping topwall adjacent to the outer sipping sidewall; a sipping port in the sipping topwall; and a central recess within the circumference of the brim sealing channel and proximate to the sipping topwall, wherein the central recess has an overhang and a bottomwall; and a rotatable closure tab includes: a central portion; a flanged-shaped structure at a first side of the central portion; a tab sidewall supported by the flanged-shaped structure; a tab topwall extending outwardly from the tab sidewall and away from the flanged-shaped structure; a sealing depression in the tab topwall; and a retention rim extending radially from the central portion and positioned between the overhang and bottomwall of the central recess.

12 Claims, 7 Drawing Sheets

(52) U.S. Cl.
CPC ..... *B65D 2543/00046* (2013.01); *B65D 2543/00092* (2013.01); *B65D 2543/00231* (2013.01); *B65D 2543/00296* (2013.01); *B65D 2543/00351* (2013.01); *B65D 2543/00555* (2013.01); *B65D 2543/00731* (2013.01); *B65D 2543/00805* (2013.01)

(58) Field of Classification Search
CPC ..... B65D 2543/00296; B65D 2543/00351; B65D 2543/00092; B65D 2543/00231; B65D 2543/00731; B65D 2543/00046; A47G 19/2272
USPC ..... 220/254.4, 820, 821, 253, 715; 222/557
See application file for complete search history.

(56) References Cited

U.S. PATENT DOCUMENTS

| | | | | |
|---|---|---|---|---|
| 4,836,407 | A | 6/1989 | Bruce et al. | |
| 5,427,266 | A | 6/1995 | Yun | |
| 5,538,157 | A | 7/1996 | Proshan | |
| 6,230,924 | B1 | 5/2001 | Weiss et al. | |
| 6,419,112 | B1 | 7/2002 | Bruce et al. | |
| 7,055,715 | B2 | 6/2006 | Maravich et al. | |
| 2002/0020708 | A1 | 2/2002 | Weiss et al. | |
| 2003/0024929 | A1 | 2/2003 | Smith et al. | |
| 2003/0089713 | A1* | 5/2003 | Belt et al. | 220/253 |
| 2003/0089714 | A1* | 5/2003 | Dart et al. | 220/254.3 |
| 2004/0245261 | A1 | 12/2004 | Stanos et al. | |
| 2006/0096983 | A1* | 5/2006 | Patterson | 220/253 |
| 2007/0007298 | A1 | 1/2007 | Tucker et al. | |
| 2007/0029322 | A1* | 2/2007 | Durdon et al. | 220/254.4 |
| 2008/0029512 | A1* | 2/2008 | Smith et al. | 220/253 |
| 2008/0105696 | A1 | 5/2008 | Dart et al. | |
| 2013/0292381 | A1* | 11/2013 | Chen | 220/254.4 |
| 2014/0246448 | A1 | 9/2014 | Weiss et al. | |

FOREIGN PATENT DOCUMENTS

| | | | |
|---|---|---|---|
| WO | 02055405 | A1 | 7/2002 |
| WO | 2006091471 | A2 | 8/2006 |

OTHER PUBLICATIONS

PCT International Search Report dated Jul. 2, 2015 in connection with PCT International Patent Application No. PCT/US2015/018862, 4 pages.
PCT Written Opinon of the International Searching Authority dated Jul. 2, 2015 in connection with PCT International Patent Application No. PCT/US2015/018862, 6 pages.
Canadian Office Action dated Apr. 8, 2015 in connection with Canadian Patent Application No. 2732609, 4 pages.
Japanese Office Action dated Nov. 14, 2014 in connection with Japanese Patent Application No. 2013-512618, with translation 6 pages.
Office Action dated Feb. 10, 2016 in connection with U.S. Appl. No. 14/275,147.
Communication Pursuant to Article 94(3) EPC in connection with European Patent Application No. 11787056.8, 5 pages.
PCT International Search Report, mailed on Jan. 15, 2008 in connection with PCT International Patent Application No. PCT/US2007/073182, 4 pages.
PCT International Preliminary Report on Patentability, Jan. 13, 2009 (date of issuance) in connection with PCT International Patent Application No. PCT/US2007/073182, 6 pages.
PCT Written Opinion of the International Searching Authority mailed on Jan. 15, 2008 in connection with PCT International Patent Application No. PCT/US2007/073182, 5 pages.
Office Action dated Jun. 17, 2016 in connection with U.S. Appl. No. 14/554,592.
Office Action dated Aug. 25, 2016 in connection with U.S. Appl. No. 14/275,147.

* cited by examiner

LID WITH ROTATABLE CLOSURE TAB

This invention claims the benefit of U.S. Provisional Patent Application No. 61/948,268 filed on Nov. 4, 2014, which is hereby incorporated by reference in its entirety.

BACKGROUND OF THE INVENTION

Field of the Invention

The embodiments of the invention relate to a lid, and more particularly, to a lid with rotatable closure tab. Although embodiments of the invention are suitable for a wide scope of applications, it is particularly suitable for changeably sealing and opening a sipping port in a lid.

Discussion of the Related Art

In general, a lid for container snaps onto the brim of the container, preferably forming a seal between the lid and the brim that prevents liquid from seeping through. The lid typically has a sipping spout to facilitate drinking of a liquid from the container. A sipping spout is a raised portion of the lid having a sidewall upon which a user can place their lower lip and a top wall upon which a user can place their top lip over or near to sip liquid from the container. Such a sipping spout has an orifice in the top wall through which the liquid can slosh out or otherwise be spilt while the container is being transported or otherwise moved about. To prevent spillage from the orifice of the sipping spout, a user can either put their finger over the orifice of the sipping spout or cap the sipping spout with an other lid that covers the orifice of the sipping spout. The other lid is the same shape as the lid with the sipping spout having an orifice but the other lid does not have an orifice in its sipping spout shaped portion so as to block off or cover the orifice. The other lid of a two lid system may actually be comprised of more material than the lid with a sipping spout having an orifice.

Using an other lid requires two hands to open-up and/or close-off the orifice of the sipping spout as well as more than doubles the amount of materials needed to make a lid system in that two lids are used to make a closable sipping spout. Thus, a lid system that can be operated with one hand and which uses substantially less material than a two lid system is desirable. Although effective, the finger over the orifice of the sipping spout is messy and unsanitary.

SUMMARY OF THE INVENTION

Accordingly, embodiments of the invention are directed to a lid with rotatable closure tab that substantially obviates one or more of the problems due to limitations and disadvantages of the related art.

An object of embodiments of the invention is to provide a lid with rotatable closure tab in which the rotatable closure tab can be operated with one hand.

Another object of embodiments of the invention is to provide a lid with rotatable closure tab in which the rotatable closure tab is removably attached to the lid.

Another object of embodiments of the invention is to provide a lid with rotatable closure tab in which the rotatable closure tab is retained in position when closing-off the sipping port.

Another object of embodiments of the invention is to provide a lid with rotatable closure tab in which the rotatable closure tab is retained in position when not closing-off the sipping port.

Additional features and advantages of embodiments of the invention will be set forth in the description which follows, and in part will be apparent from the description, or may be learned by practice of embodiments of the invention. The objectives and other advantages of the embodiments of the invention will be realized and attained by the structure particularly pointed out in the written description and claims hereof as well as the appended drawings.

To achieve these and other advantages and in accordance with the purpose of embodiments of the invention, as embodied and broadly described, a lid with rotatable closure tab, includes the lid including: a brim sealing channel at a periphery of the lid forming a circumference; an outer sipping sidewall positioned within the circumference of the brim sealing channel and extending above the brim sealing channel to provide a surface for a lower lip of a user to seal against; a sipping topwall adjacent to the outer sipping sidewall for providing a surface over which an upper lip of the user can be positioned; a sipping port in the sipping topwall; and a central recess within the circumference of the brim sealing channel and proximate to the sipping topwall, wherein the central recess has an overhang and a bottomwall; and the rotatable closure tab including: a central portion; a flanged-shaped structure at a first side of the central portion; a tab sidewall supported by the flanged-shaped structure; a tab topwall extending outwardly from the tab sidewall and away from the flanged-shaped structure; a sealing depression in the tab topwall for sealing the sipping port; and a retention rim extending radially from the central portion and positioned between the overhang and bottomwall of the central recess.

In another aspect, a rotatable closure tab for a lid includes: a central portion for insertion into a central recess of the lid; a flanged-shaped structure at a first side of the central portion opposite to the first side; a tab sidewall supported by the flanged-shaped structure; a tab topwall extending outwardly from the tab sidewall and away from the flanged-shaped structure; a sealing depression in the tab topwall for sealing a sipping port of the lid; and a retention rim extending radially from the central portion.

In yet another aspect, a lid for a rotatable closure tab includes: a brim sealing channel at a periphery of the lid forming a circumference; an outer sipping sidewall positioned within the circumference of the brim sealing channel and extending above the brim sealing channel to provide a surface for a lower lip of a user to seal against; a sipping topwall adjacent to the outer sipping sidewall for providing a surface over which an upper lip of the user can be positioned; a sipping port in the sipping topwall; an inner sipping sidewall opposite to the outer sipping sidewall and adjacent to the sipping topwall; a central recess within the circumference of the brim sealing channel and adjacent to the inner sipping sidewall, wherein the central recess has an overhang and a bottomwall.

It is to be understood that both the foregoing general description and the following detailed description are exemplary and explanatory and are intended to provide further explanation of embodiments of the invention as claimed.

BRIEF DESCRIPTION OF THE DRAWINGS

The accompanying drawings, which are included to provide a further understanding of embodiments of the invention and are incorporated in and constitute a part of this specification, illustrate embodiments of the invention and together with the description serve to explain the principles of embodiments of the invention.

DETAILED DESCRIPTION OF THE PREFERRED EMBODIMENTS

Figure 1:
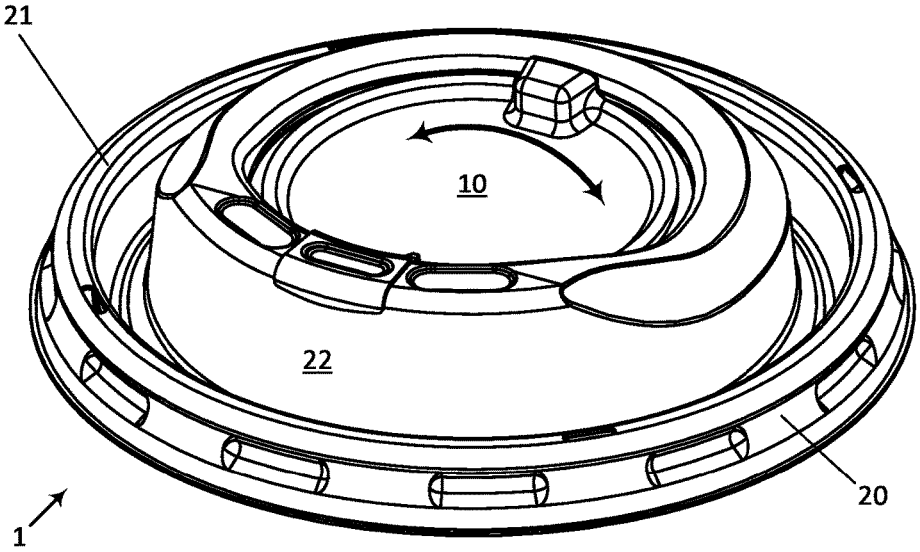
FIG. 1 is a front perspective view of a lid with a rotatable closure tab according to an embodiment of the invention.

Reference will now be made in detail to the preferred embodiments of the invention, examples of which are illustrated in the accompanying drawings. Reference will now be made in detail to the preferred embodiments of the invention, examples of which are illustrated in the accompanying drawings. The invention may, however, be embodied in many different forms and should not be construed as being limited to the embodiments set forth herein; rather, these embodiments are provided so that this disclosure will be thorough and complete, and will fully convey the concept of the invention to those skilled in the art. In the drawings, the thicknesses of layers and regions are exaggerated for clarity. Like reference numerals in the drawings denote like elements.

Figure 2:
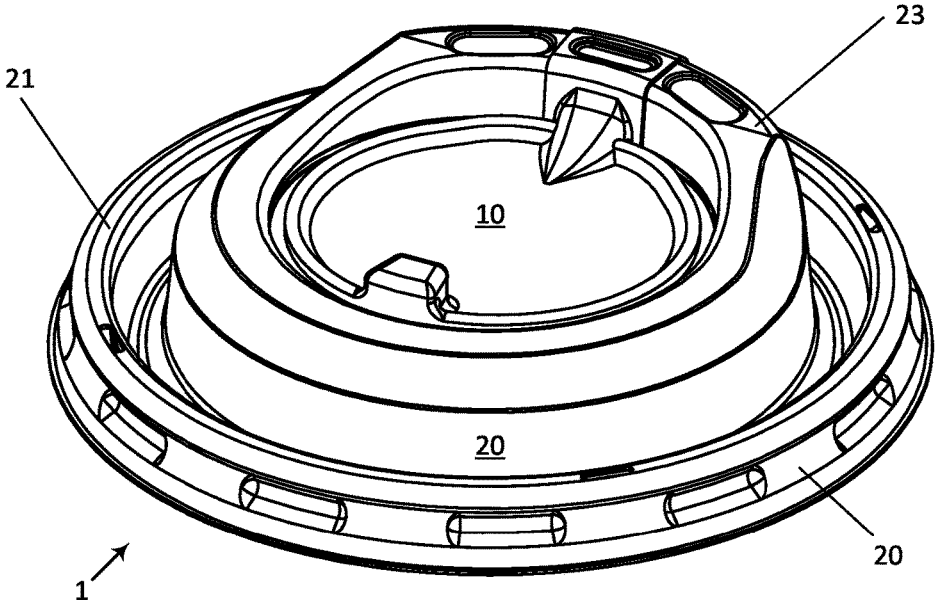
FIG. 2 is a rear perspective view of a lid with a rotatable closure tab according to an embodiment of the invention.

FIG. 1 is a front perspective view of a lid with a rotatable closure tab according to an embodiment of the invention. FIG. 2 is a rear perspective view of a lid with a rotatable closure tab according to an embodiment of the invention. As shown in FIGS. 1 and 2, a reclosable lid system 1, includes a rotatable closure tab 10 and a lid 20. The rotatable closure tab 10 can be rotated left or right, as shown in FIG. 1. A brim sealing channel 21 is at the periphery of the lid 20 so as to form a circumference at the periphery of the lid 20. That is, the brim sealing channel completely circumvents the lid 20 near the periphery of the lid 20. An outer sipping sidewall 22 of the lid 20 positioned within the brim sealing channel 21 and extending above the brim sealing channel 21 to provide a surface for the lower lip of a user to seal against. A sipping topwall 23 adjacent to and abutting the outer sipping sidewall 22 provides a surface over which the upper lip of the user can be positioned. As shown in FIG. 1, the lid 20 can have other topwalls but the sipping topwall is the topwall in which the sipping port is located.

Figure 3:
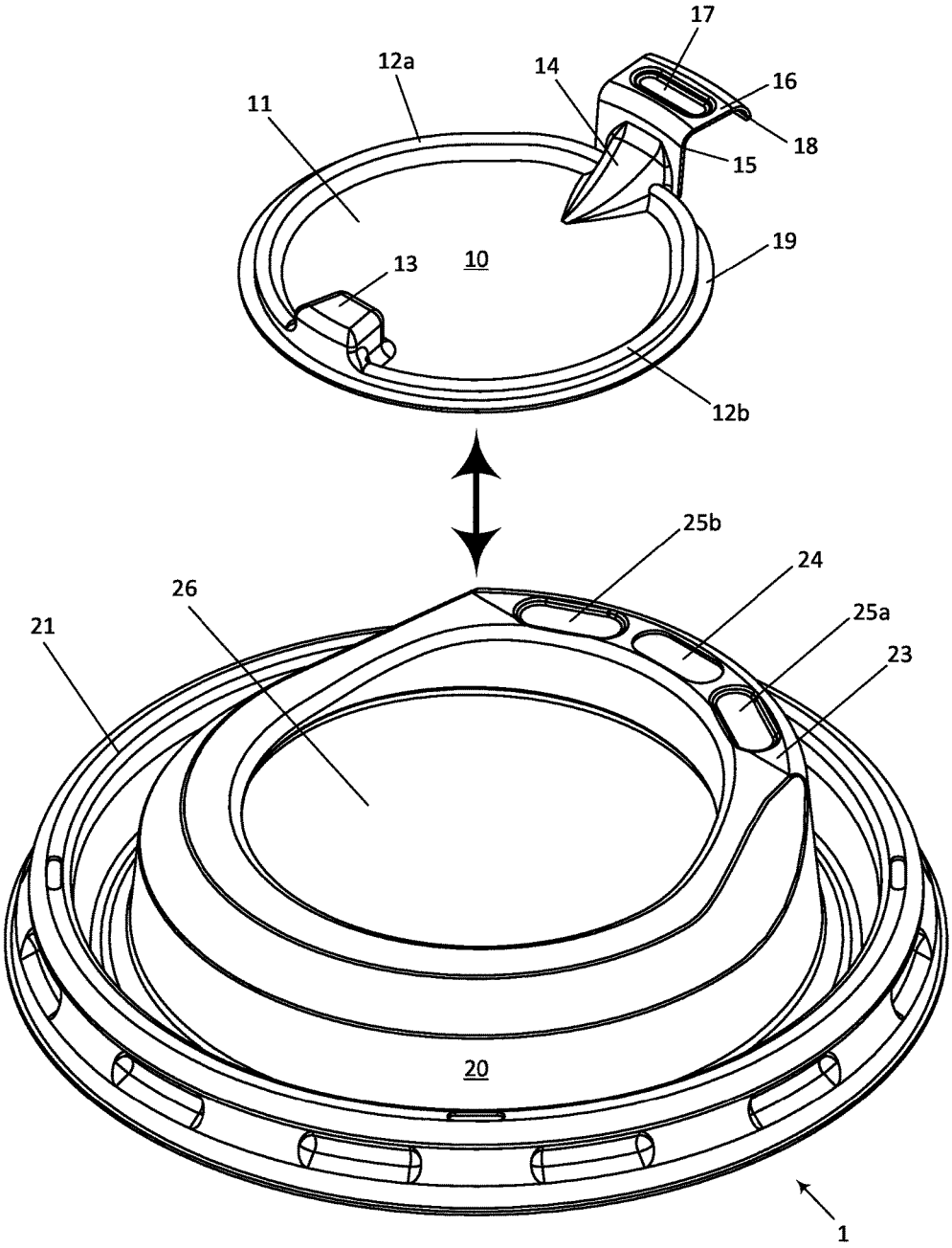
FIG. 3 is a rear perspective view of a lid showing that a rotatable closure tab for the lid is removable according to an embodiment of the invention.

FIG. 3 is a rear perspective view of a lid showing that a rotatable closure tab for the lid is removable according to an embodiment of the invention. As shown in FIG. 3, the rotatable closure tab 10 includes a central portion 11 with a nub 13 and flanged-shaped structure 14 that are on opposite sides of the central portion 11 and opposite to each other. Further, the central portion 11 can also be bounded by two reinforcement channels 12*a* and 12*b* on opposite sides of the central portion 11. The two reinforcement channels 12*a* and 12*b*, the nub 13 and the flanged-shaped structure 14 protrude upwardly from the central portion 11. The surface of the central portion 11 can be flat or embossed with a design or logo. Although two reinforcement channels 12*a* and 12*b* are shown in the disclosed exemplary embodiments, the reinforcement channels 12*a* and 12*b* can alternatively be shelves that step down a level or omitted entirely.

The flanged-shaped structure 14 provides vertical support for a tab sidewall 15 that extends up and is positioned beyond the periphery of the two reinforcement channels 12*a* and 12*b*. Although a five faceted flanged-shaped structure 14 is shown in the disclosed exemplary embodiments, a flange-shaped structure can have two, three, four, six or more facets. Further, other geometric shapes can be implemented to provide vertical support for the tab sidewall 15.

A tab topwall 16 extending outwardly from the tab sidewall 15 and away from the flanged-shaped structure 14 and the two reinforcement channels 12*a* and 12*b*. A sealing depression 17 in the tab topwall 16 is provided for sealing a sipping port. Further, the sides of the sealing depression 17 increase the rigidity of the tab topwall 16.

A tab flap 18 extending from the tab topwall 16 and away from the flanged-shaped structure 14 and the two reinforcement channels 12*a* and 12*b*. A retention rim 19 extends outwardly beyond the nub 13 and the two reinforcement channels 12*a* and 12*b* toward the periphery of the rotatable closure tab 10.

The lid 20, as shown in FIG. 3, includes a sipping port 24 and retention depressions 25*a* and 25*b* in the sipping topwall 23, which is adjacent to the outer sipping sidewall 22 shown in FIG. 1. The sealing depression 17 in the tab topwall 16 is configured to seal the sealing port 24 or be retained by one of the retention depressions 25*a* and 25*b*. The lid 20 includes a central recess 26 for receiving the rotatable closure tab 10. The central recess 26 is within the circumference of the brim sealing channel 21 and proximate to the sipping topwall 23.

The separate rotatable closure tab can be manufactured on another manufacturing line different than the manufacturing line for the lid having a central recess. Manufacturing costs for making the rotatable closure tab are less than the costs of making a lid because the rotatable closure tab is smaller and uses less material. Further, a separate rotatable closure tab can be produced from a different gauge of material. That is, the rotatable closure tab is made of a thinner material than the lid to save even more costs. Compared to using one lid to seal another lid, the use of a rotatable closure tab to seal a lid is considerably cheaper.

The separate rotatable closure tab can be a different color than the lid or even a different material. For example, a black HIPS lid with a clear rotatable closure tab, in which the clear rotatable closure tab is a naturally clear material, such as clarified PP or APET. In another example, the rotatable closure tab is a black PP and the lid is a green APET.

The separate rotatable closure tab provides a modular capability for a lid with a central recess. The lid with a central recess can be used without the separate rotatable closure tab. The separate rotatable closure tab can be optionally added onto a lid with a central recess by a retailer's employee or a customer at a point of sale. Thus, and when, they wish to select it, and place it (snapping it into place) on the lid, thus creating the rotatable closure.

Figure 4:
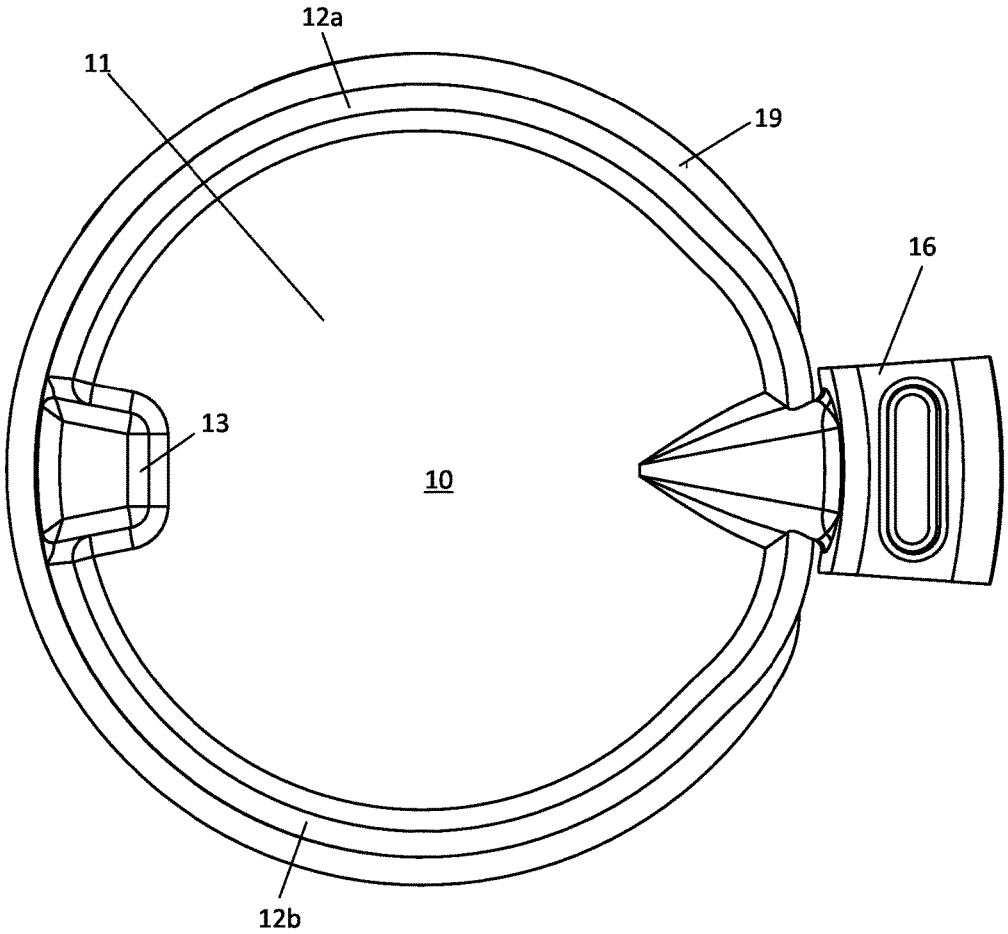
FIG. 4 is a top view of a rotatable closure tab according to an embodiment of the invention.

FIG. 4 is a top view of a rotatable closure tab according to an embodiment of the invention. As shown in FIG. 4, the rotatable closure tab 10 has a retention rim 19 extending radially from the central portion and is non-circular. That is, the retention rim 19 extends outwardly from the nub 13 and portions of the two reinforcement channels 12*a* and 12*b*. Additionally, the retention rim 19 can not extend out at both the nub 13 and at the flanged-shaped structure 14 but yet still extend at the reinforcement channels 12*a* and 12*b*. The lack of a retention rim 19 under the tab topwall 16 facilitates ease in both insertion and removal of the rotatable closure tab 10 from the central recess 26 of the lid 20. However, in another alternative embodiment, the retention rim 19 can be annular.

Figure 5:
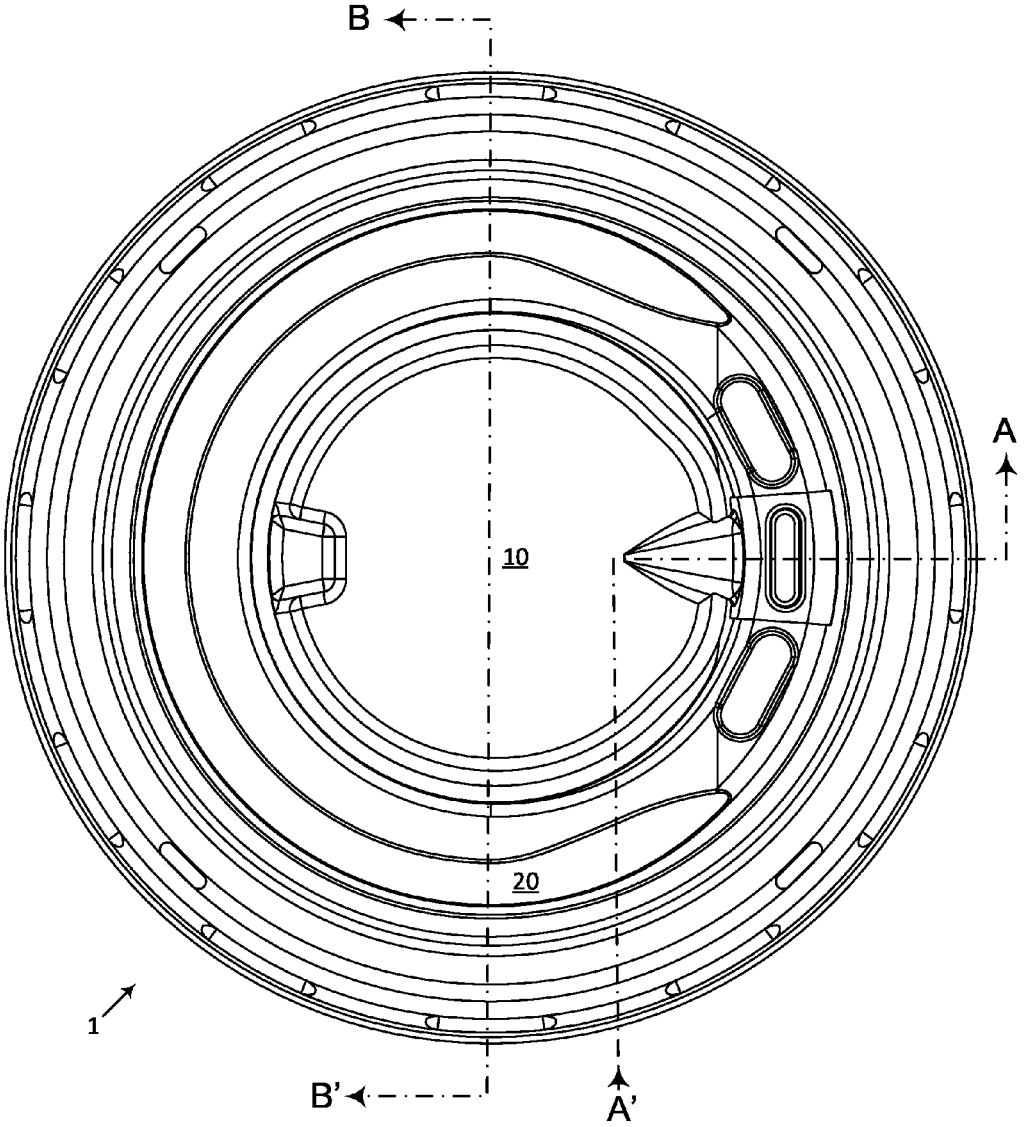
FIG. 5 is a top view of a lid with a rotatable closure tab according to an embodiment of the invention.
Figure 6:
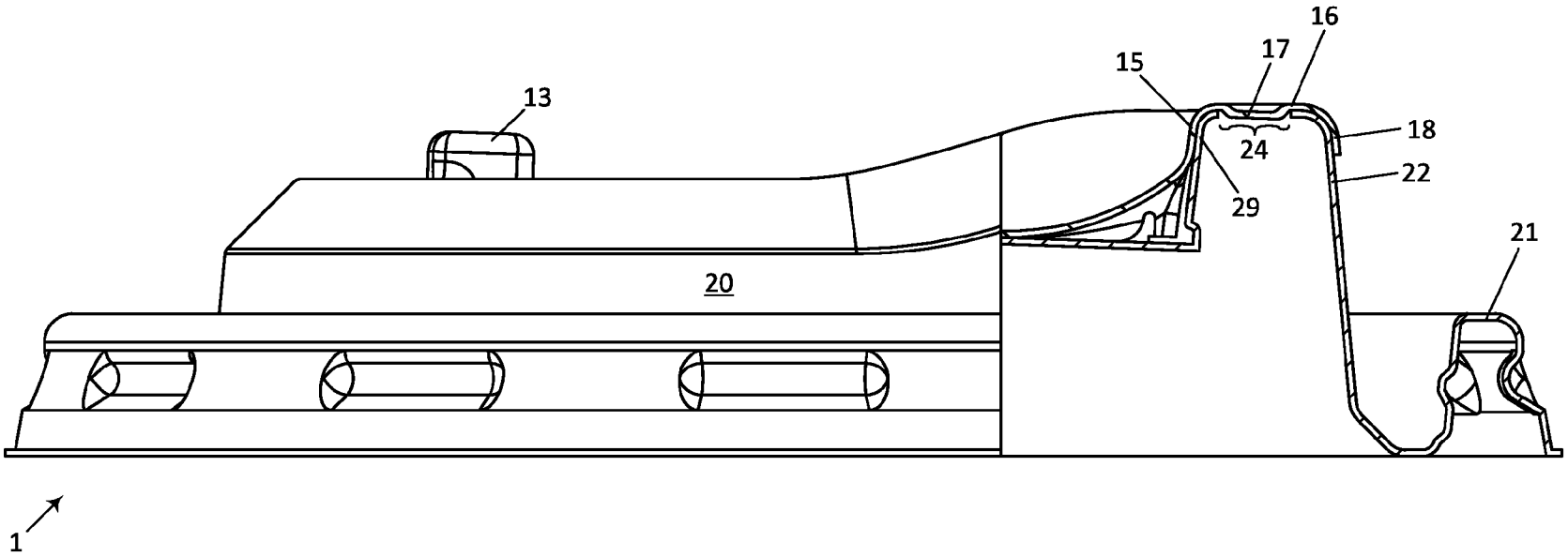
FIG. 6 is a side cross-sectional view of a lid with a rotatable closure tab along line A-A' of FIG. 5.

FIG. 5 is a top view of a lid with a rotatable closure tab according to an embodiment of the invention. FIG. 6 is a side cross-sectional view of a lid with a rotatable closure tab along line A-A' of FIG. 5. As shown in FIG. 6, a sealing depression 17 in the tab topwall 16 seals the sipping port 24. The tab flap 18 shown in FIG. 6 extends from the tab topwall 16 over and adjacent to the outer sipping sidewall 22, which extends above the brim sealing channel 21. Further, the tab sidewall 15 is over and adjacent to an inner sipping sidewall 29, which is opposite to the outer sipping sidewall 22 of the lid 20. The inner sipping sidewall 29 is adjacent to the central recess 26 of the lid 20.

Figure 7:
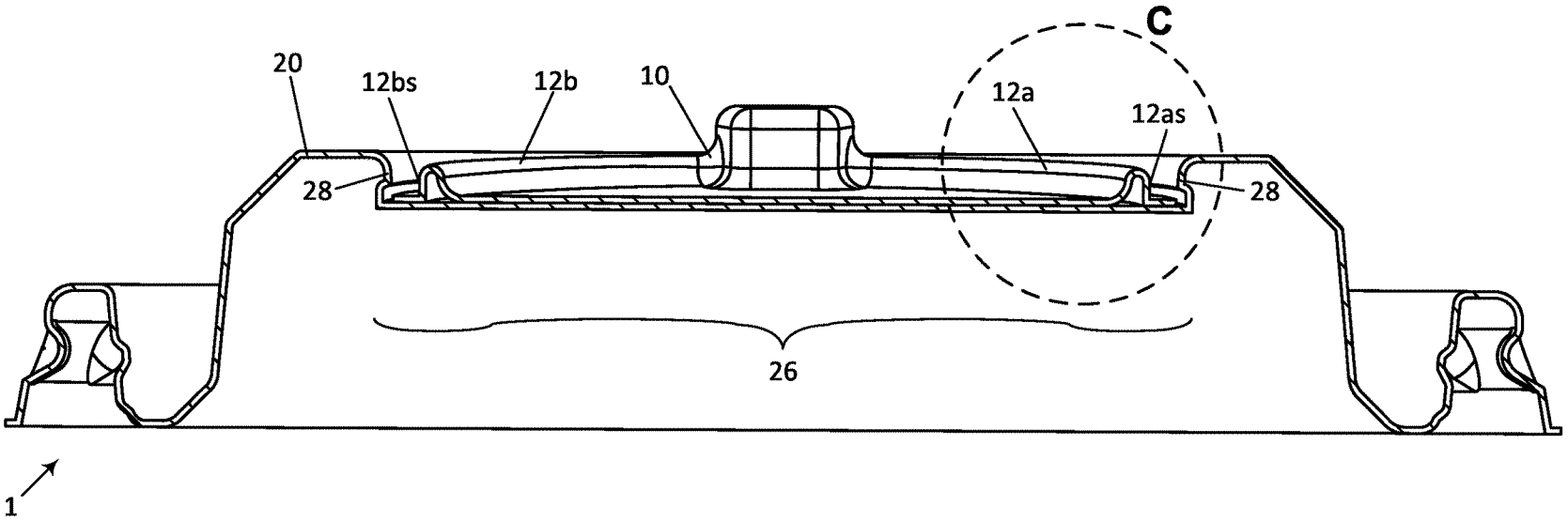
FIG. 7 is a side cross-sectional view of a lid with a rotatable closure tab along line A-A' of FIG. 5.

FIG. 7 is a side cross-sectional view of a lid with a rotatable closure tab along line A-A' of FIG. 5. As shown in FIG. 7, a rotatable closure tab 10 is positioned in the central recess 26 of the lid 20. The two reinforcement channels 12*a* and 12*b* have flat exterior surfaces 12*as* and 12*bs* opposite to the innermost sidewall 28 of the central recess 26 in the lid 20.

Figure 8:
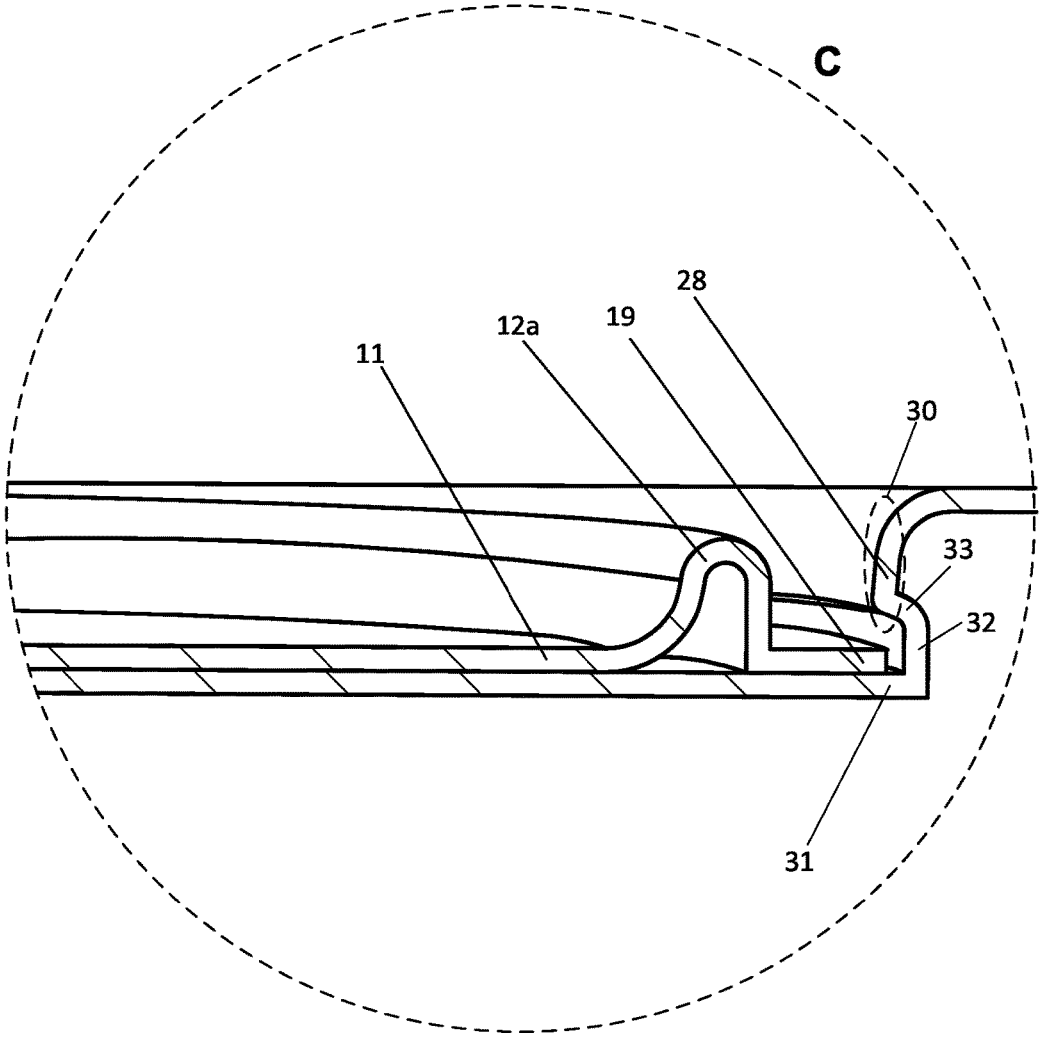
FIG. 8 is an enlarged cross-sectional side view of area C in in FIG. 7.

FIG. 8 is an enlarged cross-sectional side view of area C in in FIG. 7. As shown in FIG. 8, the innermost sidewall 28 is part of an overhang 30 at the periphery of the central recess 26 in the lid 20. The bottomwall 31 of the central recess 26 extends under the innermost sidewall 28 of the central recess 26 toward an outermost sidewall 32 of the central recess 26. An interconnect sidewall 33 interconnects the innermost sidewall 28 and the outermost sidewall 32. The interconnect sidewall 33 from the innermost sidewall 28 to the outermost sidewall 32 creates the overhang 30. The rotatable closure tab 10 is retained in the central recess 26 of the lid 20 by the overhang 30 through positioning at least an outer portion of the retention rim 19 of the rotatable closure tab 10 directly between the innermost sidewall 28 and the bottomwall 31 of the central recess 26 in the lid 20. Although the disclosed exemplary embodiment shows a central recess with a circular overhang disposed about the entire periphery of the central recess, the overhang of the central recess could be two overhangs that are in opposite quadrants of the central recess, a semicircle or a series of semicircles. Further, the surface of the bottomwall 31 can be flat or embossed with a design, logo or some other marking.

A rotatable closure according to embodiments of the invention is modular in that manufacturing of the rotatable closure may be produced on dedicated line separate from the production of the lid. Thus, the rotatable closure can be made separately and offered for sale as an adjunct to the lid, which can be purchased with or without the rotatable closure feature. The modularity serves to provide the end user with a sipping port option as, for example, the current lid user has in choosing whether to use a splash stick as an insert into sipping port. Because the rotatable closure is an add-on, the rotatable closure can be made from a different material than the lid. For example, the rotatable closure can be made of polypropelene, which settles and shrinks at a far less predictable rate than high impact polystyrene (HIPS), while the lid is made of HIPS. In addition to brand markings on the bottomwall of the central recess of the lid, specific product markings indicative of contents in a container can be on the central portion of the rotatable closure. In another alternative, product markings can be on the central recess of the lid while advertisement is on the central portion of the rotatable closure. Accordingly, embodiments of the invention provide for more flexibility in manufacturing, distribution, customer experience and marking of a lid with a closure.

It will be apparent to those skilled in the art that various modifications and variations can be made in the embodiments of the invention without departing from the spirit or scope of the invention. Thus, it is intended that embodiments of the invention cover the modifications and variations of this invention provided they come within the scope of the appended claims and their equivalents.

What is claimed is:

1. A lid with rotatable closure tab, comprising:

the lid including:

a brim sealing channel at a periphery of the lid forming a circumference;

an outer sipping sidewall positioned within the circumference of the brim sealing channel and extending above the brim sealing channel to provide a surface for a lower lip of a user to seal against;

a sipping topwall adjacent to the outer sipping sidewall for providing a surface over which an upper lip of the user can be positioned; a sipping port in the sipping topwall;

and a circular central recess within the circumference of the brim sealing channel and proximate to the sipping topwall, wherein the central recess has an overhang and a bottomwall;

and the rotatable closure tab including:

a central portion;

a flanged-shaped structure at a first side of the central portion and a nub at a second side of the central portion opposite to the first side;

a tab sidewall supported by the flanged-shaped structure;

a tab topwall extending outwardly from the tab sidewall and away from the flanged-shaped structure;

a sealing depression in the tab topwall for sealing the sipping port and opposite the nub;

and a retention rim extending radially from the central portion and positioned between the overhang and bottomwall of the central recess, and wherein the rotatable closure tab, retained in the lid, is rotatable left or right relative to the sipping port of the lid.

2. The lid with rotatable closure tab according to claim 1, wherein the retention rim is non-circular.

3. The lid with rotatable closure tab according to claim 1, further comprising an innermost sidewall and an outermost sidewall at an outer portion of the central recess.

4. The lid with rotatable closure tab according to claim 3, wherein the innermost sidewall is a part of the overhang.

5. The lid with rotatable closure tab according to claim 3, wherein the bottomwall of the central recess extends under the innermost sidewall toward the outermost sidewall.

6. The lid with rotatable closure tab according to claim 3, further comprising a reinforcement channel near a periphery of the central portion.

7. The lid with rotatable closure tab according to claim 1, further comprising a nub at a second side of the central portion opposite to the first side.

8. The lid with rotatable closure tab according to claim 1, wherein the overhang is circular.

9. A rotatable closure tab for a lid, comprising:

a central portion for insertion into a circular central recess of the lid;

a flanged-shaped structure at a first side of the central portion and a nub at a second side of the central portion opposite to the first side;

a tab sidewall supported by the flanged-shaped structure;

a tab topwall extending outwardly from the tab sidewall and away from the flanged-shaped structure;

a sealing depression in the tab topwall for sealing a sipping port of the lid;

and a retention rim extending radially from the central portion.

10. The rotatable closure tab for a lid according to claim 9, wherein the retention rim is non-circular.

11. The rotatable closure tab for a lid according to claim 9, further comprising a reinforcement channel near a periphery of the central portion.

12. The rotatable closure tab for a lid according to claim 9, further comprising a nub at a second side of the central portion opposite to the first side.

* * * * *